US009498024B1

(12) United States Patent
Jacobsen

(10) Patent No.: US 9,498,024 B1
(45) Date of Patent: Nov. 22, 2016

(54) DECORATIVE BUTTON COVER

(71) Applicant: Victor James Jacobsen, Marina, CA (US)

(72) Inventor: Victor James Jacobsen, Marina, CA (US)

( * ) Notice: Subject to any disclaimer, the term of this patent is extended or adjusted under 35 U.S.C. 154(b) by 111 days.

(21) Appl. No.: 14/259,129

(22) Filed: Apr. 22, 2014

Related U.S. Application Data

(60) Provisional application No. 61/867,133, filed on Aug. 18, 2013.

(51) Int. Cl.
*A44B 1/14* (2006.01)

(52) U.S. Cl.
CPC ..... *A44B 1/14* (2013.01); *Y10T 24/367* (2015.01); *Y10T 24/3672* (2015.01)

(58) Field of Classification Search
CPC ..... Y10T 24/367; Y10T 24/3672; A44B 1/14
See application file for complete search history.

(56) References Cited

U.S. PATENT DOCUMENTS 3,343,230 A * 9/1967 Darvie ..... A44B 1/14 24/113 MP
3,777,336 A 12/1973 Anderson
4,539,731 A 9/1985 Torrini
4,793,155 A * 12/1988 Law ..... A44B 1/123 24/113 R
5,161,285 A 11/1992 Jerjian
5,195,220 A * 3/1993 Herman ..... A44B 1/04 24/113 MP
5,255,417 A * 10/1993 Herman ..... A44B 1/04 24/113 MP
5,315,739 A * 5/1994 Herman ..... A44B 1/04 24/113 MP
5,394,719 A 3/1995 Fang
5,621,951 A 4/1997 Gould
2004/0006849 A1* 1/2004 Bishop ..... A41D 25/003 24/3.4
2004/0226145 A1* 11/2004 Ouellette ..... A44B 1/14 24/113 MP
2008/0313864 A1* 12/2008 Suter ..... A44B 1/14 24/113 R
2011/0277502 A1* 11/2011 Welikson ..... A44B 1/14 63/1.18
2014/0318181 A1* 10/2014 Malvar ..... A44C 1/00 63/20
2015/0216238 A1* 8/2015 Zaboyan ..... A41B 7/02 2/69
2015/0250238 A1* 9/2015 Garcia ..... A41D 15/00 705/26.5

* cited by examiner

*Primary Examiner* — Robert J Sandy
(74) *Attorney, Agent, or Firm* — Malloy & Malloy, P.L.

(57) ABSTRACT

Clothing accessories and more specifically a decorative button cover that will convert any man's suit coat into a sports jacket. The button cover includes a locking mechanism serving to connect the button cover to a jacket button, completely covering it and changing the appearance of the due at least in part to a decorative design on the visible front surface of the button cover.

14 Claims, 4 Drawing Sheets

DECORATIVE BUTTON COVER

CLAIM OF PRIORITY FROM RELATED APPLICATIONS

The present application claims priority from U.S. Provisional Patent Application No. 61/867,133 filed on January, 19, 2014 to Victor James Jacobsen Marina, (CA), directed to SPORTSNAPS, that is hereby incorporated by reference.

BACKGROUND OF THE INVENTION

1. Field of the Invention

The inventive device described in the instant application is a button cover that will convert any man's suit coat into a sports jacket in seconds. Available in silver or gold, SmartSnaps snap over the top of the suit's coat buttons, changing the dull, formal-looking, suit coat buttons into a more informal, ornamental sports jacket button.

2. Brief Description of the Prior Art

Button covers are well known in the art. Various Patents and Published Patent applications are in fact directed to button covers. While developing the invention of the instant application independently the Inventor researched extensively the public record as well as the current market for quick button covers and the most relevant examples found in the search are mentioned in the Information Disclosure Statement (IDS) attached.

Despite all the efforts listed above prior art patents describe structures that are either not truly convenient or else involve complicated, expensive, and overly difficult assembly and/or disassembly parts and procedures. Other devices have been advertised on various media but never patented or described into a printed publication.

SUMMARY OF THE INVENTION

The inventive device disclosed in the present application generally relates to clothing accessories and more specifically to a button cover that will convert any man's suit coat into a sports jacket in seconds. This will allow for a more versatile wardrobe without the need of buying multiple jackets for different occasions. The mechanism for the invention is a button which clamps down on a jacket button completely covering it and changing the context of the situation.

It is then the principal object of the present invention is to save the expense of owning, maintaining, and transporting multiple jackets. While still being a stylish alternative to be used on a consistent basis.

It is a secondary objective of the present invention to eliminate the stress to always have to switch into different jackets for different events.

It is an additional objective of the present invention to provide a device that does not rust or deteriorate over time. It is a final objective of the present invention to provide for a device that is relatively inexpensive to build, but that can eventually be sold at a premium.

These and other objective achieved by the device of the present invention will be apparent by the drawings, by their detailed description, and by the specification here from appended.

DESCRIPTION OF THE PREFERRED EMBODIMENT

Figure 1:
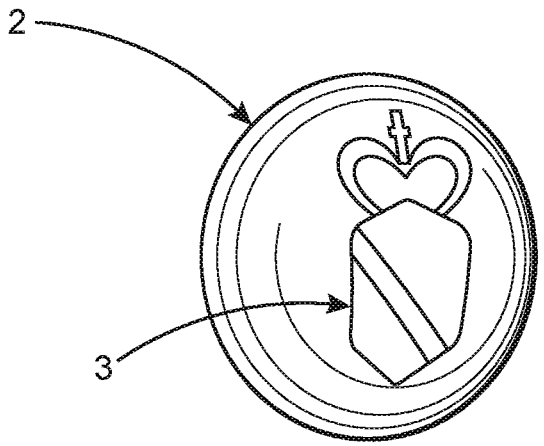
FIG. 1 is a bottom perspective view of one of the preferred embodiments of the "SmartSnaps" button cover in accordance with the teaching of the present invention.

The inventive device disclosed in the present application generally relates to clothing accessories and more specifically to a button cover that will convert any man's suit coat into a sports jacket in seconds. This will allow for a more versatile wardrobe without the need of buying multiple jackets for different occasions. The mechanism for the invention is a button which clamps down on a jacket button completely covering it and changing the context of the situation. As it can be inferred from the drawings essential components of the "SmartSnaps" of the present application include: a metal covering for the button, a logo or design, and a button to grab onto.

SmartSnaps are designed to change the appearance of a formal business suit to a more casual sports jacket by changing the appearance of the buttons. They will come in sets of eleven buttons so all the buttons up the front as well as those on the sleeves can be covered. The covers are temporarily permanent, as the covers fit securely and will not fall off under normal use. In one preferred embodiment of "SmartSnaps" of the present application will be available in silver and gold plastic and will be either plain or ornamental A further separate preferred embodiment of "Smart Snaps" will be formed of metallic silver and gold. The button cover may be formed in other colors in plastic. Custom Smart Snaps can be available, and the idea can be expanded to include attire for women, outerwear, sportswear, blouses, shoes, etc.

The specific amount of metal or plastic to be used for each individual button cover would be 2 centimeters in diameter. A print or stamp of the design may be formed on an external side of the button covers and a collapsible aluminum tab may be on an internal side of the button cover and pressed onto the button being covered. The plastic and aluminum would be durable enough not to break but cheap enough to mass produce.

The premise is that the need to change jackets or clothes from to casual attire would be streamlined to just the need of snapping buttons onto the piece of clothing. This can in the future be used for other forms of clothing.

Companies for example that deal in hospitality or customer service can cut costs by using this device to bring down the need for different jackets. For instance the need of the waiters or ushers in a hotel to have a different jacket would not be needed for they would only need to snap on the "SmartSnaps" and that would be sufficient enough to have differing uniforms.

In modern clothing and fashion design, a button is a small fastener, most commonly made of plastic, but also frequently of seashell, which secures two pieces of fabric together. Buttons are most often attached to articles of clothing but can also be used on containers such as wallets and bags. However, buttons may be sewn onto garments and similar items exclusively for purposes of ornamentation. Buttons serving as fasteners work by slipping through a fabric or thread loop, or by sliding through a buttonhole.

Figure 2:
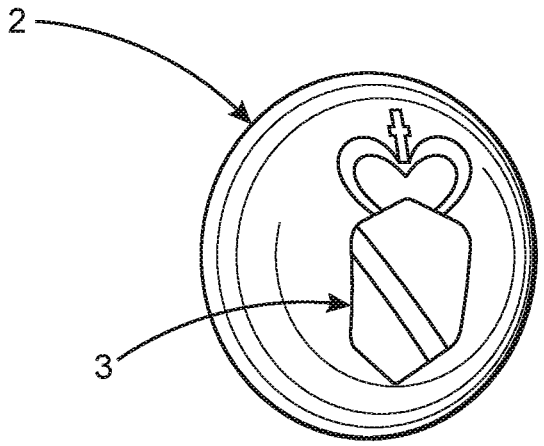
FIG. 2 is a front angled elevation view of "SmartSnaps" of FIG. 1.
Figure 3:
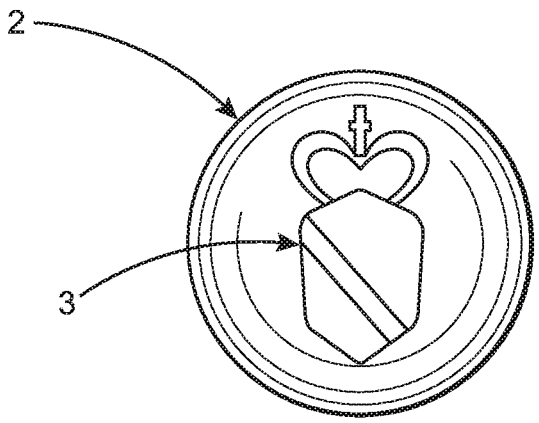
FIG. 3 is a frontal elevation view of "SmartSnaps" of FIG. 1.
Figure 4:
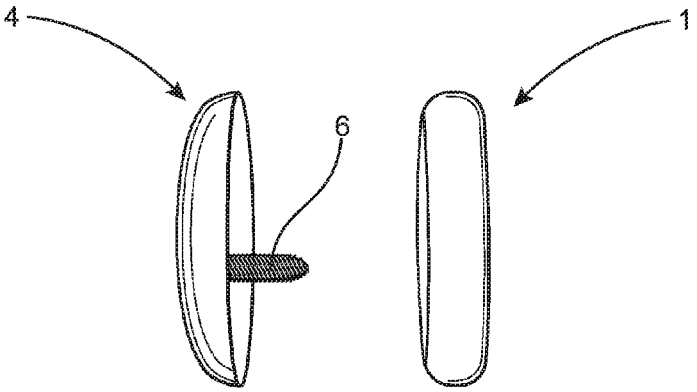
FIG. 4 is a left side elevation view in exploded form of the "SmartSnaps" button cover of FIG. 1 and corresponding button.
Figure 5:
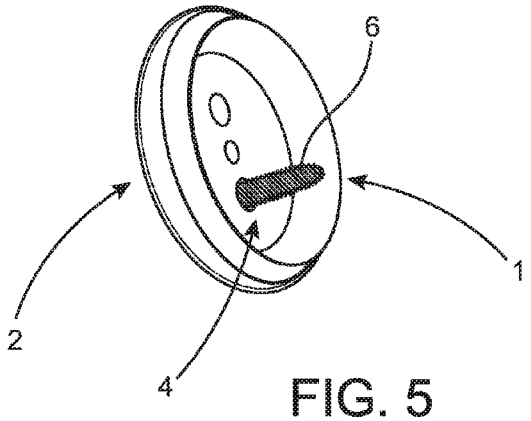
FIG. 5 is a rear angled elevation view of "SmartSnaps" of FIG. 1.
Figure 6:
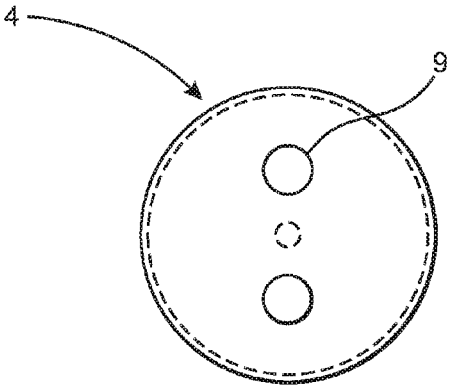
FIG. 6 is a rear elevation view of the "SmartSnaps" of FIG. 1.
Figure 7:
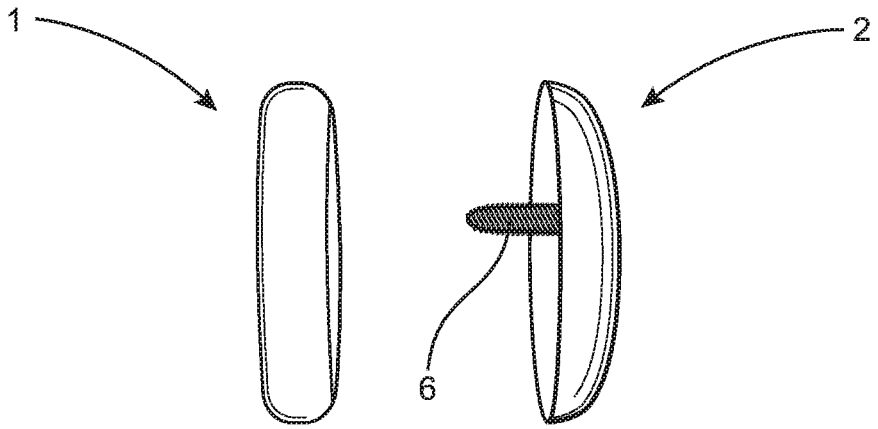
FIG. 7 is a right elevation view in exploded form of the "SmartSnaps" button cover of FIG. 1 and corresponding button.
Figure 8:
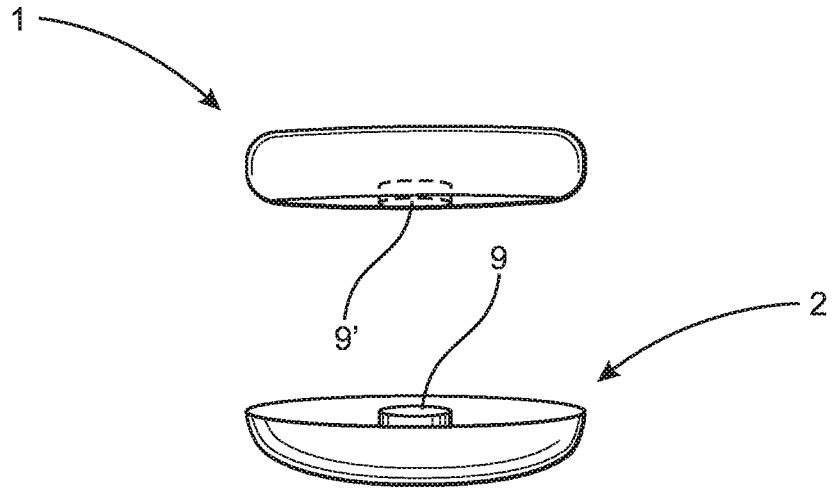
FIG. 8 is a top elevation view in exploded form of the "SmartSnaps" of FIG. 1.

One of its preferred embodiments of the inventive device of the present application embodies a casual button cover (2) for transforming a formal suit jacket into a casual sports jacket comprising: A button (1) and a round cover (2) with a decorative design (3). The cover (2) is attached to said button (1) by a collapsing metal tab (4) from which a needle (5) outwardly projects. The needle (5) attaches through a pinhole tab (6) in the button (1). In a separate preferred embodiment of the casual button cover (2) for transforming a formal suit jacket into a casual sports jacket, a decorative design (3) is disposed on the outer face or surface of the round cover (2), as represented in FIGS. 1-3. However, the decorative design (3) can be changed into a different decorative designs other than that represented. In a separate preferred embodiment of the casual button cover (2) for transforming a formal suit jacket into a casual sports jacket, the round cover (2) can be fabricated from a plastic material that can be customized into a geometric shape. Also, one or more of the embodiments of the cover (2) can be attached by a locking mechanism comprising magnetic tabs (9) and (9') respectively attached to the inside surface of the button cover (2) and the button (1). In a separate preferred embodiment of the casual button cover (2) for transforming a formal suit jacket into a casual sports jacket, the round cover (2) can be customized into any metal material and have a different geometric shape or a round shape that are attached by either the locking mechanisms including the magnetic tabs (9), (9') or the collapsible metal tab (4) and outwardly projecting needle (6), as set forth above.

A second preferred embodiment of the inventive device of the present application embodies the casual button cover (2) for transforming a formal suit jacket into a casual sports jacket being connected to normal button (1) which may have a one piece snap on structure. The button cover (2) with a decorative design (3) is attached to the normal button (1) by a collapsing metal tab (4) on the casual button cover (2) for transforming a formal suit jacket into a casual sports jacket. The decorative design (3) of said round cover (2) can be changed into a different decorative design.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A button cover for covering a clothing attached button, said button cover comprising:

a cover member including an internal side and an external side, said external side including a decorative indicia disposed thereon, said cover member structured for removable disposition in an operative position on the clothing attached button, said operative position comprising said cover member disposed in covering relation to at least an exterior of the clothing attached button, said operative position further comprising said external side and said decorative indicia disposed in a visually exposed orientation, a locking mechanism disposed and structured to at least partially define said removable disposition of said cover member on the clothing attached button, and said locking mechanism comprising a needle connected to and extending outwardly from said internal side of said cover member.

2. A button cover as recited in claim 1 wherein said decorative indicia comprises indicia printed on said external side.

3. A button cover as recited in claim 1 wherein said cover member comprises a geometric shape substantially corresponding to the clothing attached button.

4. A button cover as recited in claim 3 wherein said geometric shape is substantially round.

5. A button cover as recited in claim 1 wherein said cover member is formed from a plastic material.

6. A button cover as recited in claim 1 wherein said cover member is formed from a metallic material.

7. A button cover as recited in claim 1 said locking mechanism includes a metal tab pressed on said cover member and at least partially defining said internal side.

8. A button cover as recited in claim 7 wherein said locking mechanism is at least partially defined by said needle extending outwardly from said metal tab.

9. A button cover for covering a clothing attached button, said button cover comprising:

a cover member including an internal side and an external side, said external side including a decorative indicia disposed thereon, said cover member structured for removable disposition in an operative position on the clothing attached button, said operative position comprising said cover member disposed in covering relation to at least an exterior of the clothing attached button, said operative position further comprising said external side and said decorative indicia disposed in a visually exposed orientation, a locking mechanism disposed and structured to at least partially define said removable disposition of said cover member on the clothing attached button, and said locking mechanism comprising a first magnet tab formed on said internal side of said cover member and a second magnetic tab formed on the clothing attached button in engageable relation to said first magnetic tab.

10. A button cover as recited in claim 9 wherein said decorative indicia comprises in DC imprinted on said external side.

11. A button cover as recited in claim 9 wherein said cover member comprises a geometric shape substantially corresponding to the clothing attached button.

12. A button cover as recited in claim 11 wherein said geometric shape is substantially round.

13. A button cover as recited in claim 9 wherein said cover member is formed from a plastic material.

14. A button cover as recited in claim 9 wherein said cover member is formed from a metallic material.

* * * * *